US005704827A

United States Patent [19]

Nishi et al.

[11] Patent Number: 5,704,827

[45] Date of Patent: Jan. 6, 1998

[54] POLISHING APPARATUS INCLUDING CLOTH CARTRIDGE CONNECTED TO TURNTABLE

[75] Inventors: Toyomi Nishi; Manabu Tsujimura, both of Yokohama; Tamami Takahashi, Yamato; Hiromi Yajima, Yokohama; Riichiro Aoki, Tokyo; Yukio Imoto, Zama; Shoichi Kodama, Tokyo; Kazuaki Himukai, Chigasaki; Gisuke Kouno, Oita; Takanobu Nishimura, Chigasaki, all of Japan

[73] Assignees: Ebara Corporation, Tokyo; Kabushiki Kaisha Toshiba, Kawasaki, both of Japan

[21] Appl. No.: 544,534

[22] Filed: Oct. 18, 1995

[30] Foreign Application Priority Data

Oct. 19, 1994 [JP] Japan ..... 6-279859

[51] Int. Cl.[6] ..... B24B 5/00

[52] U.S. Cl. ..... 451/285; 451/41; 451/287; 451/451

[58] Field of Search ..... 451/41, 285, 287, 451/288, 289, 451; 15/102, 97.1

[56] References Cited

U.S. PATENT DOCUMENTS 3,968,598 7/1976 Ogawa ..... 451/288
4,365,446 12/1982 Manekata et al. ..... 451/451
4,527,358 7/1985 Day ..... 451/288
5,310,455 5/1994 Pasch et al. ..... 451/288

FOREIGN PATENT DOCUMENTS 59-44185 10/1984 Japan .
4-206929 7/1992 Japan .

*Primary Examiner*—Eileen P. Morgan
*Attorney, Agent, or Firm*—Wenderoth, Lind & Ponack

[57] ABSTRACT

A polishing apparatus includes a detachable light weight cloth cartridge which shows little deformation under uneven loading during a polishing operation. Either mechanical or non-mechanical fixation of the cloth cartridge to a turntable is achieved. Mechanical fixation involves attaching the cloth cartridge to the turntable at peripheral and center sections of the cloth cartridge. Non-mechanical fixation involves attaching the cloth cartridge to the turntable by a vacuum arrangement. The assembly of the cloth cartridge and the turntable not only produces excellent flatness on polished semiconductor wafers by maintaining a level polishing surface, but also improves the production yield by preventing breakage of wafers during the polishing process.

20 Claims, 3 Drawing Sheets

POLISHING APPARATUS INCLUDING CLOTH CARTRIDGE CONNECTED TO TURNTABLE

BACKGROUND OF THE INVENTION

1. Field of the Invention

The present invention relates in general to a polishing apparatus and relates in particular to a polishing apparatus for producing a flat, mirror polish on an object to be polished such as a semiconductor wafer.

2. Description of the Related Art

High density integrated semiconductor devices of recent years require increasingly finer microcircuits and interline spacing thereof also has shown a trend of steadily decreasing in dimension. For optical lithography operations based on an interline spacing of less than 0.5 micrometer, the depth of focus is shallow and high precision in flatness is required of a polished object which has to be coincident with a focusing plane of a stepper. This requirement means that a semiconductor wafer surface must be made extremely flat, and a first step in achieving such precision in flatness begins with proper surface preparation by polishing with a polishing apparatus.

A conventional type of polishing apparatus used in such applications comprises a turntable with a polishing cloth mounted on a top surface thereof, and a top ring, each of which are rotated independently with an object to be polished disposed therebetween. The surface of the object to be polished is pressed down onto the polishing cloth by the top ring under a controlled pressure, while a polishing solution is supplied onto the polishing cloth. The polishing process is continued until the object surface is polished to the required degree of flatness and mirror polish.

Changing of the polish cloth on the turntable is performed by stopping and polishing apparatus, removing the polishing cloth from the turntable, washing off residual polishing solution from the top surface of the turntable, drying the turntable and finally bonding a new polishing cloth directly onto the turntable. This process is time consuming and causes substantial downtime of the apparatus, thereby leading to low productivity, i.e. a low number of polished objects produced per time.

A remedial approach to this productivity problem is to use a cartridge cloth system in which a polishing cloth is bonded to a base structure and such assembly or cartridge is mounted onto and removed from the turntable. The use of the cartridge cloth system eliminates the time required to change the cloth on the turntable, thereby leading to shortening of the downtime of the apparatus and to improving productivity of the polishing apparatus. Such procedures are disclosed in Japanese Patent Publication No. S59-44185, Japanese Patent Publication No. H2-30827 and Japanese Laid-open Patent Publication No. H4-206929.

Devices for fixing a cartridge to a turntable for easy exchange of new and used cartridges are disclosed in the above-mentioned Japanese Patent Publication No. S59-44185 in which the outer periphery of the cartridge is fixed to the turntable, in the above-mentioned Japanese Laid-open Patent Publication No. H4-206929 in which a coupling device is used for attachment, and in the above-mentioned Japanese Patent Publication No. H2-30827 in which a surface tension force of a fluid is utilized.

To facilitate exchanging of a cartridge, the cartridge should be light weight. An approach to making a light weight cartridge is to make a thin cartridge. FIG. shows a conventional turntable having a cloth cartridge. A cloth cartridge 1 includes a polishing cloth 3 mounted on a base member 2 and is fixed at a peripheral portion thereof to turntable 4. However, fixing that depends only on peripheral fixation methods such as shown in FIG. 4 results in a problem during polishing that when downward pressure applied by a top ring 11 on thin cartridge 1 is increased, uneven loading applied by the top ring 11 causes the cartridge 1 to deform slightly, thus resulting in cartridge 1 lifting away from the turntable 4. The thus curled cartridge rotating with the turntable causes waving at the polishing interface, resulting in production problems such as non-flatness and breakage of the wafers.

SUMMARY OF THE INVENTION

An object of the present invention is to provide a polishing apparatus for preventing deformation of a thin cloth cartridge by the use of an attachment structure to withstand uneven loading on the cloth cartridge which may be applied during a polishing operation.

This objective is achieved in a polishing apparatus including a turntable for rotation polishing of an object, a cloth cartridge including a polishing cloth bonded to a base member rotating with and detachably mounted on the turntable, supply means for delivering a polishing solution to a polishing surface of the cloth, pressing means for pressing the object onto the polishing surface of the polishing cloth, and wherein the cloth cartridge is detachably attached to the turntable at peripheral and central sections of the cloth cartridge.

In accordance with another aspect of the polishing apparatus, the cloth cartridge can be attached to the turntable by vacuum suction means.

By providing mechanical fixation of the cloth cartridge to the turntable at two attachment sections, i.e. at the peripheral and center sections, or by non-mechanical fixation by vacuum suction, it is possible to prevent the occurrence of lifting or upward moving of the cloth cartridge caused by uneven loading on the cloth cartridge by the pressing means. When resulting curling of the cloth cartridge is prevented, the flatness of the polished wafer is improved, along with improvement of productivity by minimizing breakage of objects during a polishing process.

DETAILED DESCRIPTION OF THE INVENTION

Preferred embodiments of the invention will be explained with reference to the drawings.

Figure 1:
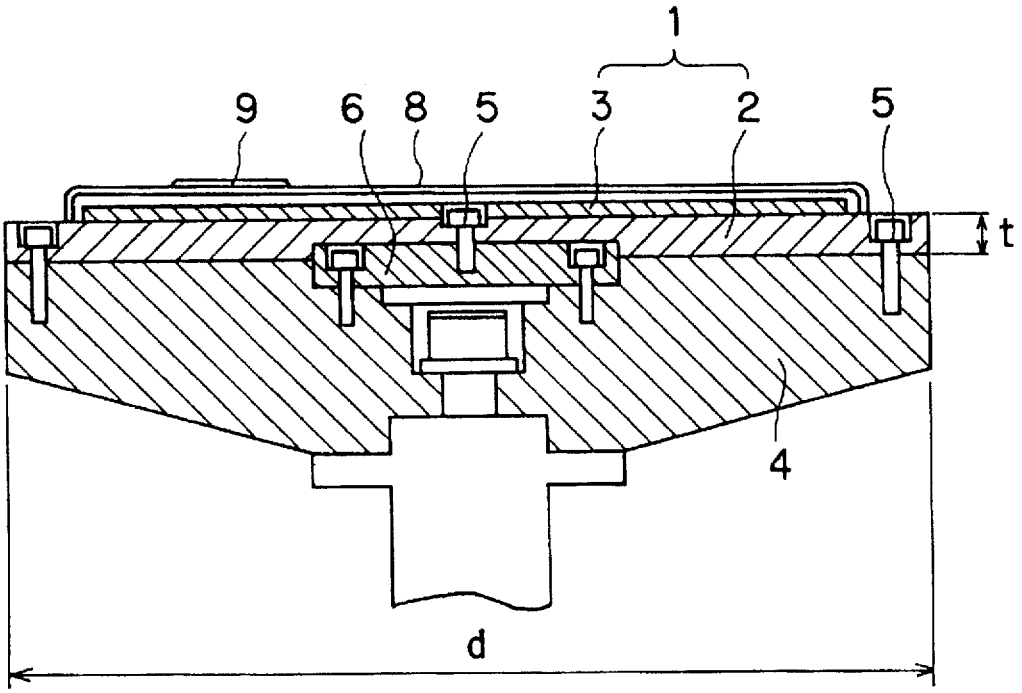
FIG. 1 is a vertical cross sectional view of a first embodiment of a cloth cartridge polishing apparatus of the present invention.
Figure 2:
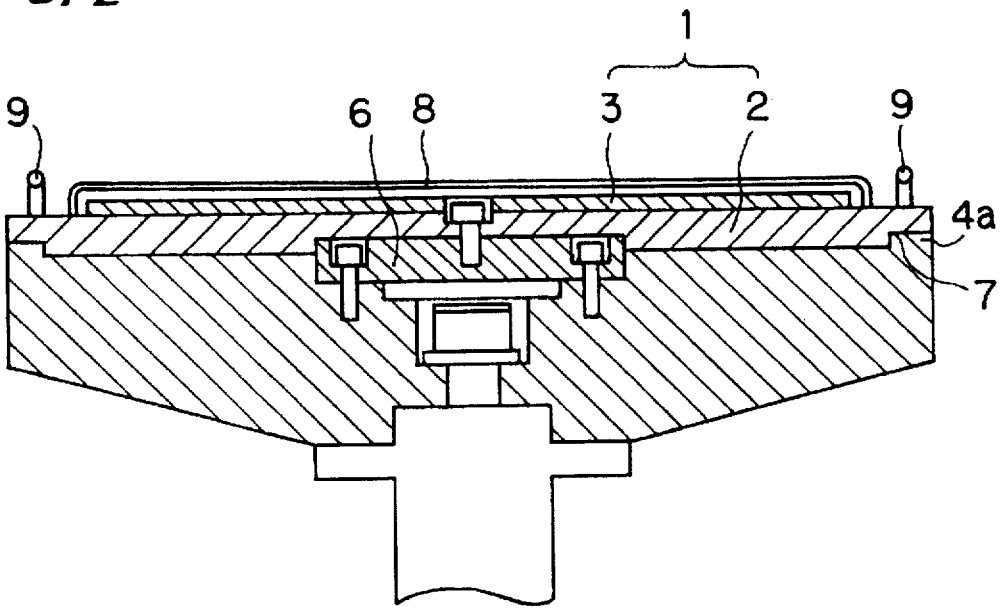
FIG. 2 is a vertical cross sectional view of the first embodiment of the polishing apparatus of the present invention, taken at a right angle to FIG. 1.

FIGS. 1 to 3 and FIG. 5 show two embodiments of the polishing apparatus of the present invention comprising a turntable and a cloth cartridge. FIGS. 1 and 2 are vertical cross sectional views of the first embodiment of the polishing apparatus comprising a cloth cartridge and a turntable. FIG. 2 is a cross sectional view taken at a right angle to FIG. 1.

Cloth cartridge 1 comprises a cloth (polishing cloth) 3 mounted on a base member 2. Bolt insertion holes are provided at an outer periphery section and at a center section of the cloth cartridge 1 for insertion of bolts to attach the cloth cartridge 1 to the turntable 4. There are corresponding bolt holes provided in the turntable 4. However, in the first embodiment, the bolt hole in the center section for the turntable 4 is formed in a disc plate 6 which is attached to the turntable 4. The disc plate 6 fits within recesses formed in the bottom surface of the cloth cartridge 1 and on the top surface of the turntable 4. Thereby assuring a coaxial alignment and fitting of the cloth cartridge 1 and the turntable 4 so as to rotate the two components 1 and 4 about the same center of rotation. The cloth cartridge 1 is disposed on the top surface of the turntable 4 and is detachably attached thereto by bolts 5 at the center and peripheral sections. A peripherally extending channel groove 7 is machined into the bottom of base member 2, and turntable 4 is provided with a peripherally extending protrusion 4*a* fitting into the channel groove 7 to prevent slippage of cloth cartridge 1 with respect to the turntable 4. As shown from a comparison of FIGS. 1 and 2, groove 7 and protrusion 4*a* do not extend entirely annularly of cartridge 1 and turntable 4. This arrangement assures that the two components 1 and 4 always rotate together. The base member 2 of the cloth cartridge 1 is made of either alloyed metals, such as stainless steel or aluminum, or plastic materials. The cloth 3 is bonded to the top surface of the cartridge 1 and is a polishing cloth such as a resin sheet (for example, Suba 800 which is made of non-woven fabric composed of fibers bound together by urethane resin, and manufactured by Rodel Products Corporation).

The polishing apparatus further comprises a freely removable cover 8, made of a plastic material or the like, which is removably attached to the top surface of the cartridge 1. A handle or handles 9 are provided near the periphery of the cloth cartridge 1 to facilitate removal and transport thereof. The base member 2 of the cloth cartridge 1 is shaped as a disc having a ratio 6/d of thickness 6 to diameter d in a range of 0.005–0.05 (refer to FIG. 1).

Figure 3:
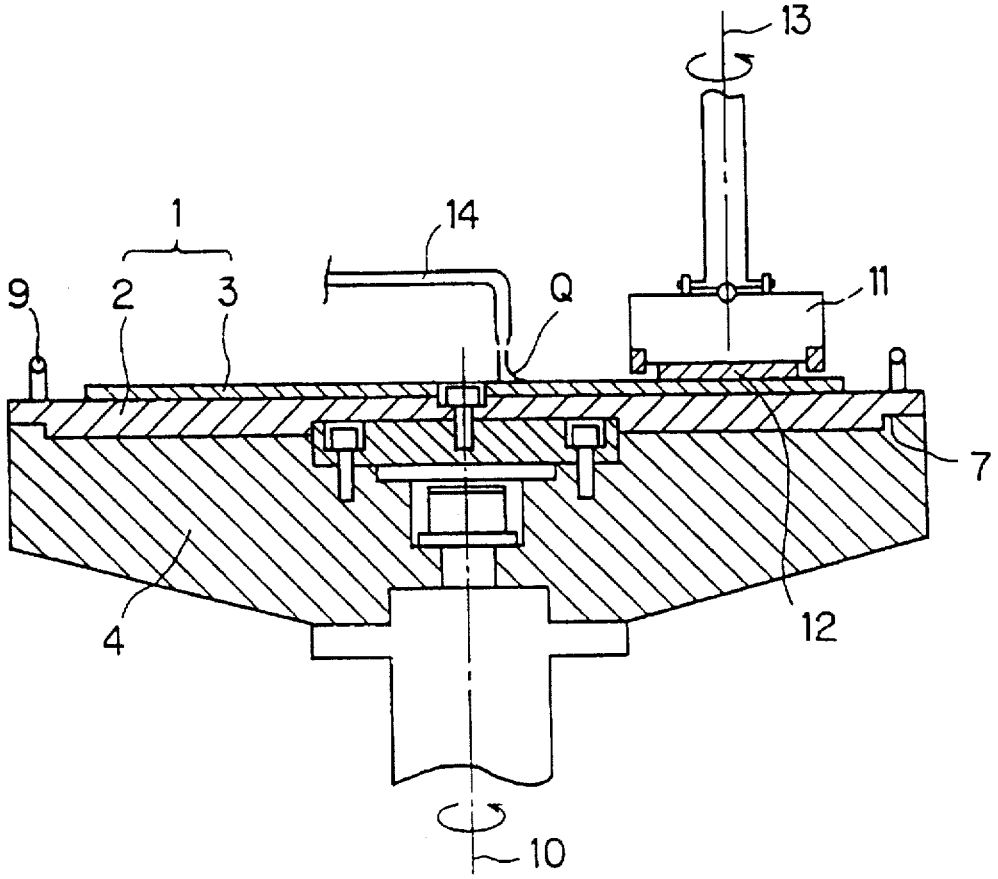
FIG. 3 is a vertical cross sectional view showing a polishing operation of the polishing apparatus of the present invention.
Figure 4:
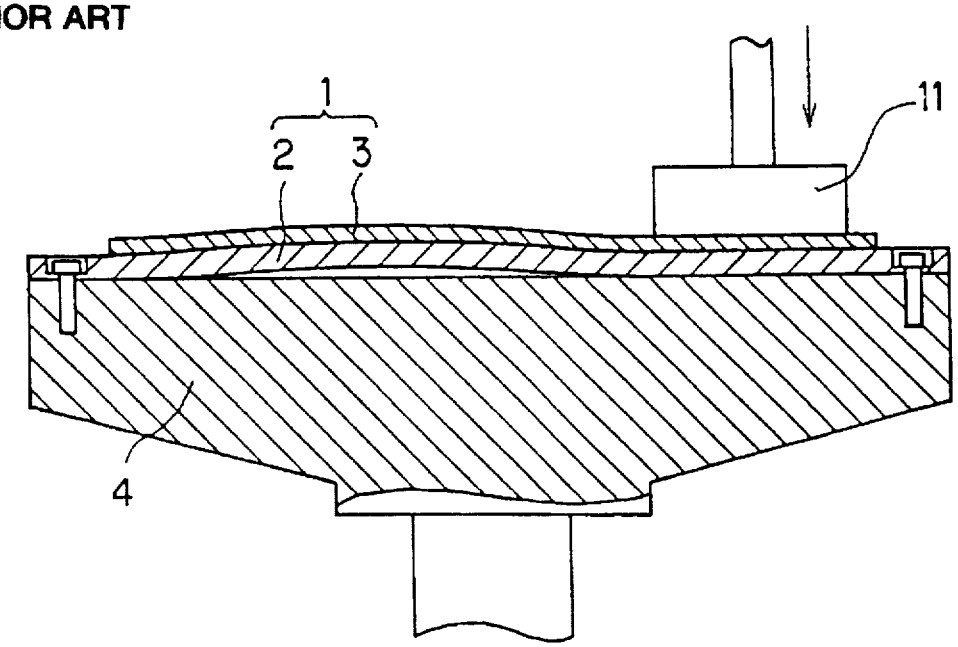
FIG. 4 PRIOR ART
FIG. 4 is a vertical cross sectional view of a conventional polishing apparatus utilizing a cloth cartridge.

FIG. 3 is a cross-sectional view illustrating a polishing operation of the polishing apparatus of the first embodiment. The cloth 3 is bonded to the top surface of the base member 2 which is disposed on the top surface of the turntable 4, and cartridge 1 is fixed at center and peripheral sections to the turntable 4. The turntable 4 rotates about rotational axis 10, thereby turning the cloth cartridge 1 fixed to the turntable 4. Above the turntable 4 is disposed a top ring 11 for holding a semiconductor wafer 12. The top ring 11 not only rotates about rotational axis 13 but also moves vertically so as to provide a specific pressing force to press semiconductor wafer 12 against cartridge 1. Above the turntable 4 is disposed a nozzle 14 for delivering a polishing solution Q onto the cloth 3.

The polishing apparatus of the above construction operates as follows. Semiconductor wafer 12 is held on the bottom surface of the top ring 11 by means of vacuum, and the top ring 11 presses the semiconductor wafer 12 onto the cloth 3 of the cloth cartridge 1. Then the turntable 4 and the top ring 11 are rotated, and polishing solution Q is flowed through the nozzle 14 onto the cloth 3. The cloth 3 holds the polishing solution Q so that solution Q contacts the surface to be polished (i.e. bottom surface) of the semiconductor wafer 12, thus to carry out polishing thereof.

In this embodiment, the cloth cartridge and the turntable are coupled by means of bolts fastened at the peripheral and center sections. However, coupling is not limited to use of bolts and can be achieved by other fixation means using other types of coupling devices, without departing from the principle of the invention.

Figure 5:
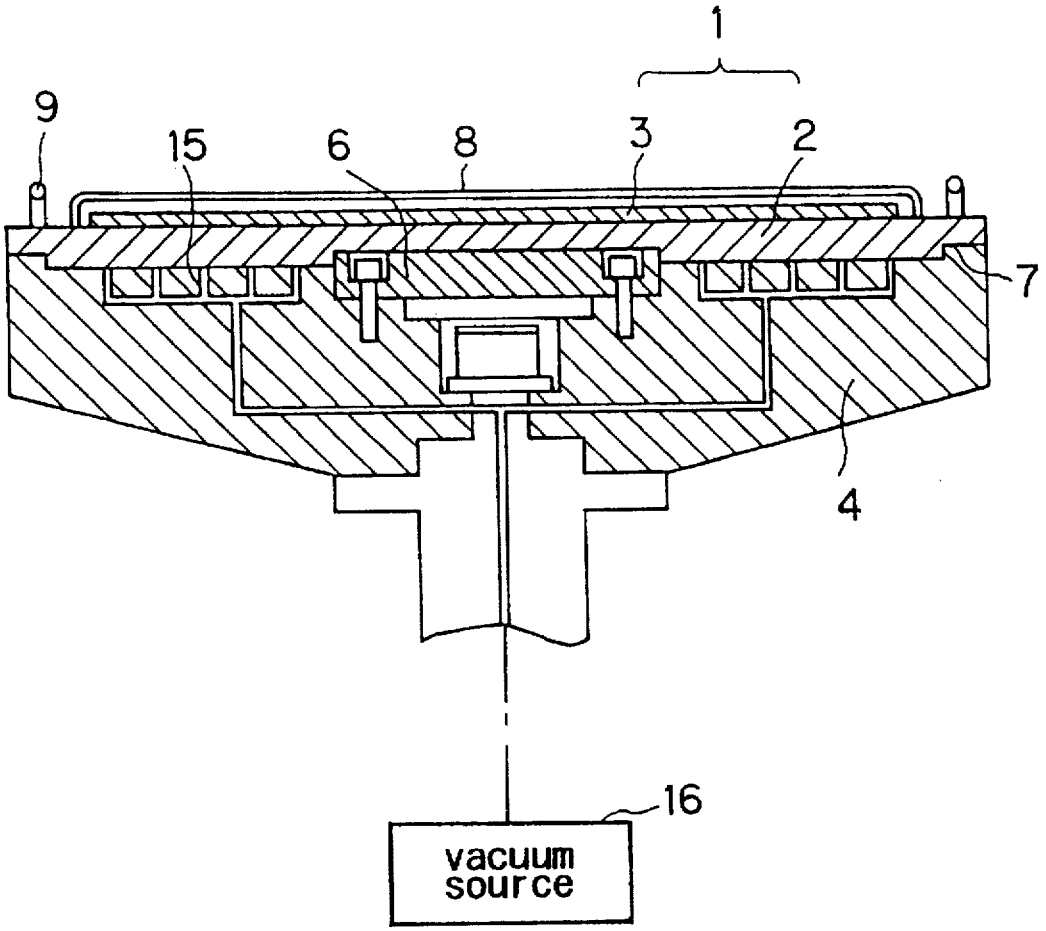
FIG. 5 is a vertical cross sectional view of a second embodiment of the polishing apparatus of the present invention.

An example of non-mechanical fixation is shown in FIG. 5 that is a cross sectional view of a second embodiment of the present invention. The turntable 4 of this embodiment is provided on the top surface thereof with a plurality of air passages 15. After placing the cloth cartridge 1 on top of the turntable 4, the air passages 15 are connected to a vacuum source 16, thereby attaching the cloth cartridge 1 to the turntable 4 by vacuum. The cloth cartridge 1 can be detached from or attached to the turntable 4 by opening passages 15 to the atmosphere or by connecting passages 15 to vacuum source 16, respectively.

As explained above, the present invention provides a polishing apparatus which prevents curling of a part of the cloth cartridge caused by unbalanced loading on the cloth cartridge. Two methods for attaching the cloth cartridge to the turntable have been illustrated, i.e. mechanical fixation at peripheral and center sections of the turntable, and vacuum fixation. The polishing apparatus of the present invention thus improves flatness of polished semiconductor wafers and improves the yield from polishing operations.

What is claimed is:

1. A polishing apparatus for polishing a surface of an object to a flat and mirror finish, said apparatus comprising:

a rotatable turntable;

a cloth cartridge including a base member and a polishing cloth bonded to said base member;

said cloth cartridge having a peripheral section and a central section detachably connected directly at a peripheral section and at a central section, respectively, of said turntable, such that said cloth cartridge is rotatable with said turntable;

supply means for delivering a polishing solution to a polishing surface of said polishing cloth; and pressing means for pressing an object to be polished onto said polishing surface of said polishing cloth.

2. An apparatus as claimed in claim 1, wherein said peripheral section and said central section of said cloth cartridge comprise peripheral and central portions, respectively, of said base member.

3. An apparatus as claimed in claim 2, further comprising bolts detachably connecting said peripheral and central portions to said peripheral and central sections, respectively, of said turntable.

4. An apparatus as claimed in claim 1, wherein said cloth cartridge is disc-shaped and has a ratio t/d of thickness t to diameter d in a range of from 0.005 to 0.05.

5. An apparatus as claimed in claim 1, wherein said cloth cartridge and said turntable have interfitting structure operable to prevent slipping of said cloth cartridge relative to said turntable during rotation thereof.

6. An apparatus as claimed in claim 5, wherein said interfitting structure comprises a groove formed in one of said base member and said turntable and a protrusion extending from the other of said base member and said turntable, said protrusion fitting into said groove.

7. An apparatus as claimed in claim 6, wherein said groove and said protrusion extend peripherally of said base member and said turntable.

8. An apparatus as claimed in claim 1, further comprising a cover member positionable on said base member to entirely cover said polishing cloth when not in use for polishing operation.

9. An apparatus as claimed in claim 1, wherein said cloth cartridge has a handle to facilitate detachment and transportation thereof.

10. An apparatus as claimed in claim 1, wherein said base member is made of a material selected from the group consisting of steel alloys, aluminum alloys and plastic materials.

11. An assembly to be used as part of a polishing apparatus for polishing a surface of an object to a flat and mirror finish, said assembly comprising:

a rotatable turntable;

a cloth cartridge including a base member and a polishing cloth bonded to said base member; and said cloth cartridge having a peripheral section and a central section detachably connected directly at a peripheral section and at a central section, respectively, of said turntable, such that said cloth cartridge is rotatable with said turntable.

12. An assembly as claimed in claim 11, wherein said peripheral section and said central section of said cloth cartridge comprise peripheral and central portions, respectively, of said base member.

13. An assembly as claimed in claim 12, further comprising bolts detachably connecting said peripheral and central portions to said peripheral and central sections, respectively, of said turntable.

14. An assembly as claimed in claim 11, wherein said cloth cartridge is disc-shaped and has a ratio t/d of thickness t to diameter d in a range of from 0.005 to 0.05.

15. An assembly as claimed in claim 11, wherein said cloth cartridge and said turntable have interfitting structure operable to prevent slipping of said cloth cartridge relative to said turntable during rotation thereof.

16. An assembly as claimed in claim 15, wherein said interfitting structure comprises a groove formed in one of said base member and said turntable and a protrusion extending from the other of said base member and said turntable, said protrusion fitting into said groove.

17. An assembly as claimed in claim 16, wherein said groove and said protrusion extend peripherally of said base member and said turntable.

18. An assembly as claimed in claim 11, further comprising a cover member positionable on said base member to entirely cover said polishing cloth when not in use for polishing operation.

19. An assembly as claimed in claim 11, wherein said cloth cartridge has a handle to facilitate detachment and transportation thereof.

20. An assembly as claimed in claim 11, wherein said base member is made of a material selected from the group consisting of steel alloys, aluminum alloys and plastic materials.

* * * * *